United States Patent [19]

Leandris

[11] Patent Number: 4,842,541

[45] Date of Patent: Jun. 27, 1989

[54] ELECTRICAL CONNECTOR

[75] Inventor: Sergio Leandris, Fenouillet, France

[73] Assignee: Precision Mechanique Labinal, Montigne Le Brettonneux, France

[21] Appl. No.: 196,544

[22] Filed: May 20, 1988

[30] Foreign Application Priority Data

May 22, 1987 [FR] France ..... 87 07234

[51] Int. Cl.[4] ..... H01R 11/11

[52] U.S. Cl. ..... 439/281; 439/282; 439/744

[58] Field of Search ..... 439/278, 279, 281, 282, 439/353, 355, 357, 358

[56] References Cited

U.S. PATENT DOCUMENTS

| | | | |
|---|---|---|---|
| 3,937,545 | 2/1976 | Cairns et al. | 439/281 |
| 4,127,314 | 11/1978 | Hasimoto . | |
| 4,214,802 | 7/1980 | Otani et al. | 439/281 |
| 4,571,017 | 2/1986 | Fujita | 439/282 |

FOREIGN PATENT DOCUMENTS

| | | |
|---|---|---|
| 2377715 | 8/1978 | France . |
| 2004424 | 3/1979 | United Kingdom . |

*Primary Examiner*—Joseph H. McGlynn
*Attorney, Agent, or Firm*—Sandler & Greenblum

[57] ABSTRACT

A female electrical connector and a male electrical connector. The two connectors are designed to interconnect in a locking relationship. The female electrical connector is an insulative housing member, formed from two parts and a locking mechanism is provided for locking together the two parts. The first of the two parts has a plurality of parallel passages and a cylindrical female contact member retained at one end of each of the parallel passages. Each of the female contact members is attached at one end to an electrical conductor and is provided with a collar proximate the other end. A resilient tang having at least one projection is provided for cooperation with the collar. A latching mechanism is provided for holding the two insulative housing members together. The second part of the female insulative housing member has a body section which is adapted to receive the first part of the female housing member. The body has a back wall with holes aligned with the parallel passages. Either the female or the electrical connector can be provided with a skirt for receiving the other member. A male contact member is retained in each of the passages and is attached to an electrical conductor. A locking mechanism is provided for holding together the first and second parts of the male member. Passages are located in the first part of the male insulative housing member have holes adapted for passage of the cylindrical members and for cooperation with one end of a collet on the male contact member. Resilient tangs cooperate with the other end of the collet. The second part of the male member can be provided with a skirt adapted to receive the first part member of the male member.

31 Claims, 6 Drawing Sheets

ELECTRICAL CONNECTOR

BACKGROUND OF THE INVENTION

The present invention concerns an electrical connector of the type having a housing member with a series of parallel passages, each of which contains a cylindrical female contact, and a housing member with a series of parallel passages, each of which contains a male contact. The male contacts are in the form of cylindrical members adapted to be inserted into the corresponding female contacts, and the two housing members are adapted to be fixed together to make an electrical connection.

There are very many known connectors of the type having a female insulative connector unit and a male insulative connector unit, where the female unit has a female electrical contact adapted for receiving a male electrical contact housed in the male electrical contact.

However, these connectors tend to be relatively difficult to assemble and the insertion of the various male and female contacts tends to be difficult to mechanize.

It is, therefore, an object of the present invention to provide a connector that is relatively simple to assemble and which enables the insertion of the various male and female contacts into their respective passages to be mechanized.

SUMMARY OF THE INVENTION

The invention relates to a female electrical connector and to a male electrical connector. The two connectors are designed to interconnect in a locking relationship.

The female electrical connector is an insulative housing member, formed from two parts. A locking mechanism is provided for locking together the two parts.

The first of the two parts has at least one, and preferably a plurality of parallel passages. A cylindrical female contact member is positioned in each of the parallel passages. An opening is provided at at one end of each passage, for retaining the female contact member. Each of the female contact members has, at one end, an attachment mechanism for attachment to an electrical conductor. A collar is provided proximate the other end of the female contact member, the second end being opposite the first end. An abutment means is provided at the end of each parallel passages which is opposite to the end at which the opening is located. The abutment means is adapted to retain the second end of the female contact member and is provided with a resilient tang which has at least one projection and which is adapted to cooperate with the collar.

A latching mechanism is provided for holding the two insulative housing members together.

The second part of the female insulative housing member has a body section which is adapted to receive the first part of the female housing member. The body has a back wall with holes which are adapted to be aligned with the parallel passages.

The female electrical connector can be provided with a skirt for receiving a male insulative housing member.

Each of the passages has an interior wall and a projection on the inside wall. The projection includes a ramp and an abrupt end, with the ramp facing towards the aforenoted passage opening.

Each of the resilient tangs includes a projection which in turn has a ramp facing towards the opening and an abrupt end. The abrupt end of the ramp is coplanar with the abrupt end of the projection on the inside wall of the first passage. The passages have a longitudinal axis perpendicular to the plane common to both of the abrupt ends.

Each of the resilient tang of the first part of the female insulative housing member has, on the side opposite to the projection, a rib the height of which is such that when the first and second part members are assembled together, the resilient tang is urged towards the female contact.

Two locking lugs are provided on opposite sides of the first part and the second part member of the female insulative housing member is provided with respective holes adapted to receive the lugs by virtue of elastic deformation.

Each female contact is electrically conductive, has crimped tabs at one end and a tubular conduit portion. The tubular conduit has a rolled elongate rectangular part. The collar is positioned at the free end. The free end is outwardly folded at a fold line to form the collar.

The elongate rectangular part has apertures which are in line with the fold line of the collar. The elongate rectangular part additionally has a stamped longitudinal blade with a curved free end adapted to bear against an inside surface of the collar. The blade has at least one boss and the aforenoted rectangular part has at least one longitudinal upstanding portion.

The male electrical connector is an insulative housing member having at least one, and preferably a plurality, of parallel passages.

A male contact member is provided in each of the passages. The passages have an opening for insertion of the male contact and retaining means for retaining the male contact. Each male contact has one end adapted for attachment of an electrical conductor and a cylindrical region having a first end opposite its second end. The second end is adapted to be inserted into one of the female contacts.

Each the male contact member having a collet which is intermediate the first and second ends.

A latching mechanism is provided for holding the first and second insulative housing members together.

The male connector is formed in two parts and a locking mechanism is provided for locking together the two parts. The passages are located in the first part of the male insulative housing member. The passages have, at one end, holes adapted for passage of the cylindrical members and for cooperation with one end of the collet. Resilient tangs are provided with projections adapted to cooperate with the other end of the collet. The second part member of the male insulative housing member can be provided with a skirt adapted to receive the first part member of the male housing member.

The male insulative housing member can be provided with a skirt adapted to receive the female insulative housing member.

The first part of the insulative housing member has projections at the free end of the resilient tangs, on the side towards the second passage means. The projections include a ramp which faces towards the openings and has an abrupt end.

The skirt of the second part of the insulative housing member has at least one inclined surface whereby, when the first part member of second insulative housing member is inserted into the second part member of the second insulated housing member, the resilient tangs are urged towards the male contacts.

Each of the male contacts is made of metal and has crimping lugs at one end. The collet is proximate the other end, between the crimping lugs and the cylindrical member.

The first part of the male insulative housing member has at least two locking lugs on opposite sides and the second part of the second insulative housing member has corresponding holes. The holes are adapted to receive the lugs by elastic deformation.

BRIEF DESCRIPTION OF THE DRAWINGS

The invention will now be described in more detail and by way of example only with reference to one specific embodiment shown in the appended drawings.

DESCRIPTION OF PREFERRED EMBODIMENT

Figure 1:
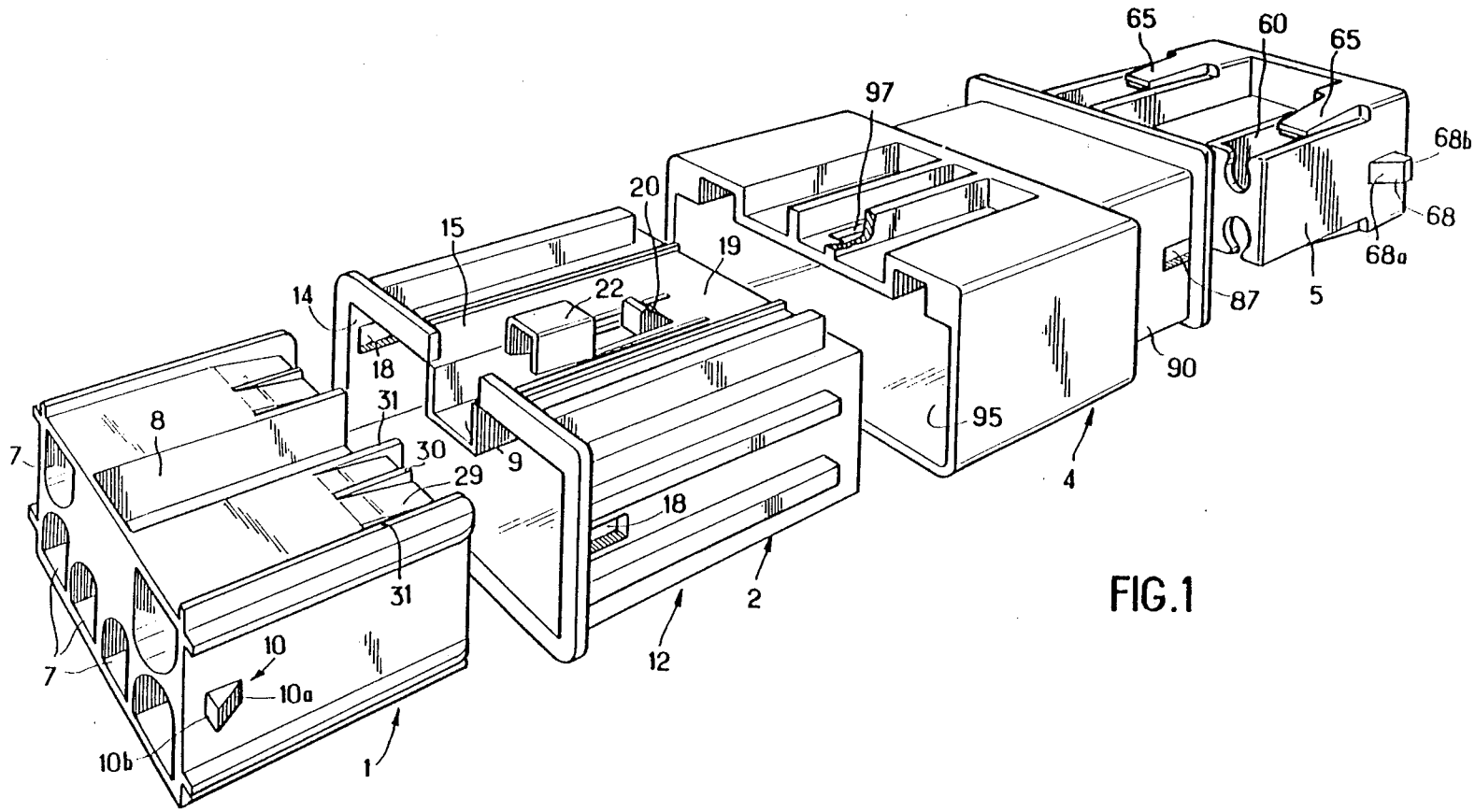
FIG. 1 is a perspective view showing all component parts of the electrical connector in accordance with the invention.

The first insulative housing member has at least one, and preferably a plurality of parallel first passages. Each of the first passages has an opening at one end for receiving a female contact member and means for retaining the female contact member. One end of each female contact member has means for attaching to an electrical conductor. At the opposite end of each female contact, facing towards the means for attaching to an electrical conductor, is a collar. At least one, and preferably a plurality of parallel second passages are provided in the second insulative housing member. A male contact member is provided in each second passage and an opening is provided in each second passage for inserting the male contact member. Each of the second passages has means for retaining the male contact. Each male contact member has means at one end for attaching an electrical conductor and a cylindrical member at the opposite end of each male contact adapted to be inserted into one of the female contact members. A collet is provided on each male contact intermediate its two ends. A skirt on the first or second insulative housing member is adapted to receive the other of the insulative housing members. A latching means is provided for holding the first and second insulative housing members together. In the electrical connector, each of the two insulative housing members has first and second parts and locking means for holding the first and second parts together. The first part of the first insulative housing member includes the first passages and an abutment member. The abutment member is positioned at the end of each first passage opposite the opening and is adapted to retain the end of said female contact opposite the electrical conductor attachment means. A resilient tang, and at least one projection on the resilient tang are adapted to cooperate with the collar. The second part of the first insulative housing member includes a body section adapted to receive the first part of the first insulative housing member. A back wall of the body, and holes in the back wall are adapted to be aligned with the first passages. The first part of the second insulative housing member includes the second passages. Holes at one end of the second passages are adapted to have the cylindrical members pass through them and to cooperate with one end of the collets. Resilient tangs, and projections on the resilient tangs are adapted to cooperate with the other end of the collets. The second part of the second insulative housing member includes a skirt adapted to receive the first part of the second insulative housing member.

The connector as shown in the figures, includes two housing members 1 and 2, which are adapted to accommodate female contacts 3 and two housing members 4 and 5 which are adapted to accommodate the male contacts 6.

The housing member 1 is molded from a plastics material and has a series of passages 7, each of which is adapted to receive one female contact 3.

In its upper part the housing member 1 has a groove 8 designed to cooperate with a rib 9 on the housing member 2 to constitute a polarizing system.

The housing member has, on two opposite sides, small side lugs, indicated general as 10. The lugs 10 have an inclined ramp **10*a* with an abrupt end 10*b***.

The housing member 2 is molded from a plastics material and has four lateral walls 12, 14, 15 and 16 and a back wall 13.

In the back wall 13 are circular holes which correspond to the passages 7, the lateral walls 12 and 14 each having an opening 18 corresponding to one of the lugs 10.

In the rib 9 is an elastic tang 19 on which are formed a latch member 20 and a button 22.

Each passage 7 has an opening 26 for inserting the member 3 and, at its opposite end, an opening 27 for the corresponding male contact 6 to pass through.

On an inside wall of each passage 7 is a projection 23 having, on the side facing towards the insertion opening 26, a ramp **23*a* and on the other side an abrupt edge 23*b***.

The opening 27 is bordered by two abutment members 24. The free ends of the abutment members 24 are circular arc shaped and lie on a circle whose diameter is substantially equal to that of the male member 6.

In the walls of passage 7 of the housing member 1, are slits 31. The slits 31 are on the walls opposite those carrying the projections 23 and form elastic tangs 29. The walls have, on their outside surface, a longitudinal rib 30 and on their inside surface, a projection 33. The projection 33 is shaped to feature, on the side facing towards the opening 25, a ramp 33*a* and, on the side facing towards the opening 27, an abrupt edge 33*b*.

The abrupt edges 33*b* and 23*b* are situated in the same plane perpendicular to the longitudinal axis of the passages 7 and at a distance from the abutment members 24.

The female contact 3 is shown in detail in FIGS. 9 through 12 and is made from a strip of metal that is a good electrical conductor and has some degree of elasticity.

The contact member 3 is cut to a shape which provides for two lugs 42 for crimping onto an electrical conductor, two lugs 43 for crimping onto the insulative sheath of the electrical conductor, and an elongate rectangular part 50. A smaller side 47 at the end opposite the crimping lugs 43, is slightly flared.

The female contact 50 has an opening 49 along which extends a blade 40 carrying a boss 48. The contact 50 has longitudinal stamped projecting portions 41. The blade 40 is curved at its end 46.

Figure 10:
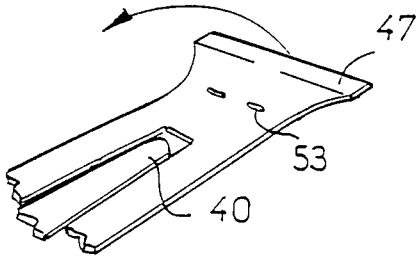
FIG. 10 is a fragmentary perspective view of the female contact member of FIG. 9.
Figure 12:
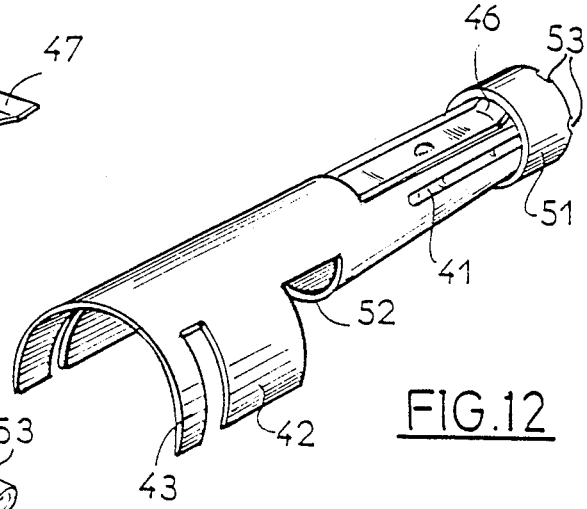
FIG. 12 is a perspective view of the female contact member of FIG. 11, shown in the finished stage.
Figure 11:
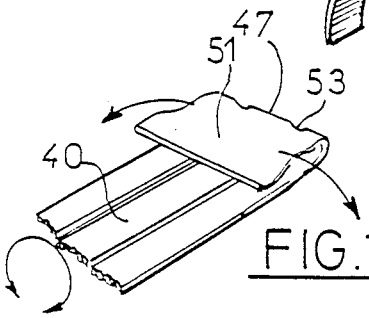
FIG. 11 is a fragmentary perspective view of the female contact member of FIG. 10, shown in the first forming stage.
Figure 14:
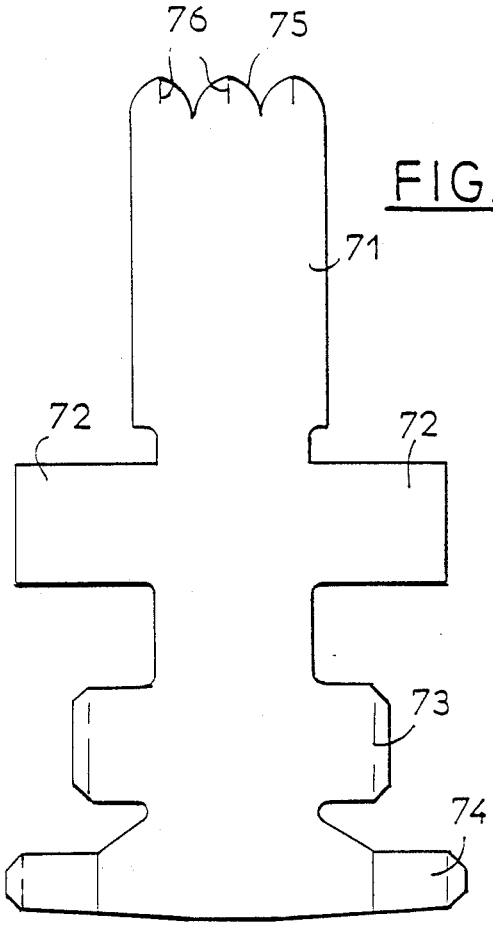
FIG. 14 is a plan view of the male contact member in its original flat state.
Figure 17:
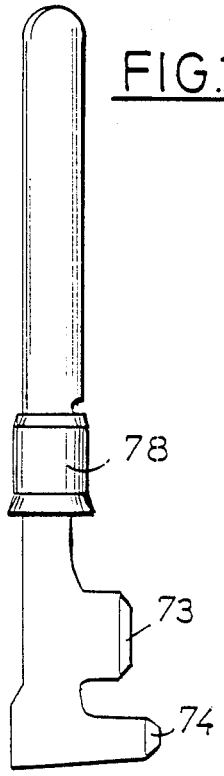
FIG. 17 is an elevational view of the finished male contact member.

The female contact 3 (as illustrated in FIGS. 10, 11 and 12) is formed by folding end 47 outwardly so as to form a collar 51. The resulting part is then rolled (see FIG. 12) to form a tubular conduit 52.

The curved end 46 ends up bearing against the collar 51 so that the blade 40 projects slightly into the conduit 52.

Figure 2:
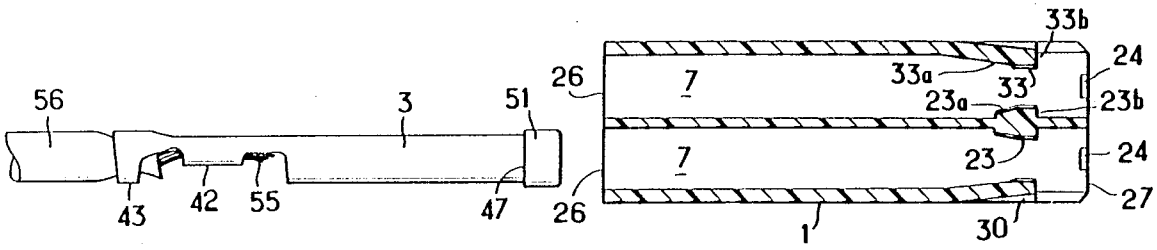
FIG. 2 is a longitudinal cross-section of a first female contact housing member and a female contact.
Figure 3:
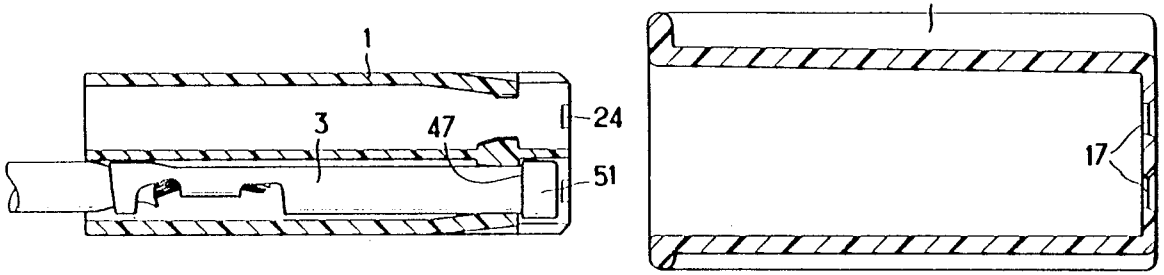
FIG. 3 is a longitudinal cross-section of both female contact housing member parts.
Figure 4:
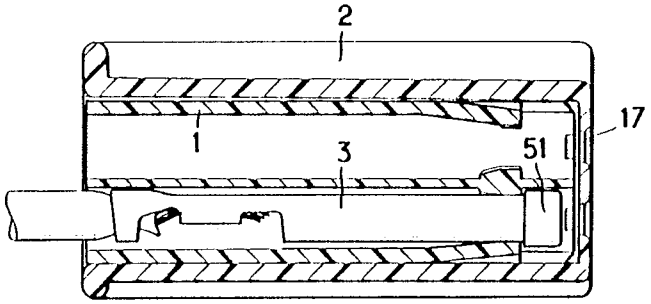
FIG. 4 is a cross-sectional view of the several component parts of FIGS. 2 and 3 in their assembled form.
Figure 5:
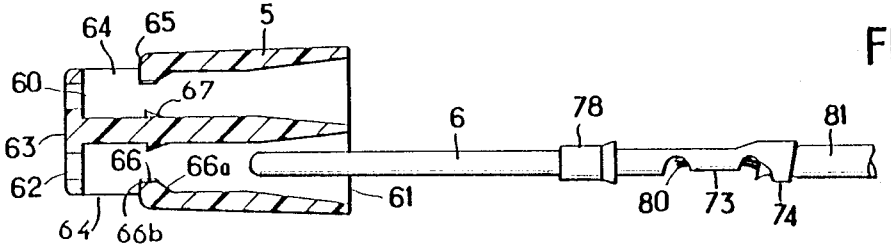
FIG. 5 is a longitudinal cross-sectional view of a first male contact housing member.

As seen in FIGS. 2, 3 and 4 the contact 3 receives a conductor 55 which is crimped between the lugs 42 and the insulative sheath 56 of which is gripped between the lugs 43. The contact 3 is inserted into a passage 7 until the collar 51 bears against the abutment members 24, while the abrupt edges 23*b* and 33*b* cooperate with the end 47.

The female contacts 3 are therefore retained in the passages 7. The housing member part 1 is then inserted into the housing member part 2 until the lugs 10 enter the holes 18. The insertion of the lugs 10 depends on slight elastic deformation of the housing members parts 1 and 2 and is facilitated by the inclined ramps 10*a*. When the lugs are locked the two housing member parts 1 and 2 can no longer be separated.

Rib 30 on the lugs 29 may have a height such that when housing member 1 is inserted into housing member 2, lugs 29 are urged towards the walls carrying the projections 23 so that the contacts 3 are completely locked into passages 7.

Small slits or holes 53 can be provided along the fold line for collar 51 to prevent the formation of creases.

Housing member 5 is molded from a plastics material and has at least one, and preferably a plurality of passages 60, each of which is adapted to receive a male contact 6. Each passage 60 includes an opening 61 for inserting the contact member 6 and an end wall 63. Contact 6 is passed through a hole 62 in the end wall 63.

Each passage 60 includes an opening 64 in the vicinity of end wall 63. Housing member 5 has, for each passage 60, an elastic tang 65. The free end of tang 65 has on its inside surface a projection 66 which includes an inclined ramp 66*a* and an abrupt end 66*b*. Facing each elastic tang 65 is a projection 67.

Housing member 5 has, on each of two opposite sides, a lug 68 which includes a ramp 68*a* and an abrupt end 68*b*.

Male contact member 6 is shown in detail in FIGS. 14 through 17. It is made from a strip of metal that is a good electrical conductor and cut to a shape which includes a rectangular member 71 at one end. Edge 75 of the rectangular member 71 is scolloped and provide with slits 76. The other end includes two lateral strips 72 and crimping lugs 73 and 74 on the far side of the lateral strips 72.

Figure 15:
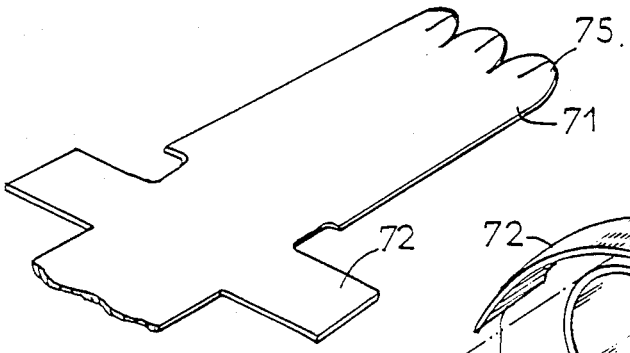
FIG. 15 is a fragmentary perspective view of the male contact member of FIG. 14.
Figure 16:
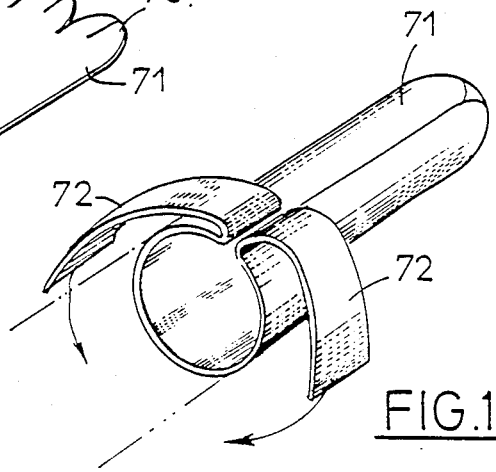
FIG. 16 is a perspective view of the male contact member of FIG. 15, shown in its next stage of formation.

As shown in FIGS. 15 and 16, the contact member made by rolling the rectangular member 71 so as to obtain a cylindrical member with a rounded free end. The lateral strips 72 are folded outwardly over the cylindrical member to form a collet 78, one end of which is slightly flared.

A conductor 80 is crimped between the lugs 73 and its sheath 81 is crimped between the lugs 74. The contact member 6 is inserted into a corresponding passage 60 and its rounded end passes through the hole 62 until the corresponding end of the collet 78 butts up against the end wall 63, while the flared opposite end of the collet is retained by the abrupt edge 66b of projection 66. Polarizing means are provided so that housing member part 5 can be inserted into skirt 86 in one specific position only.

Figure 6:
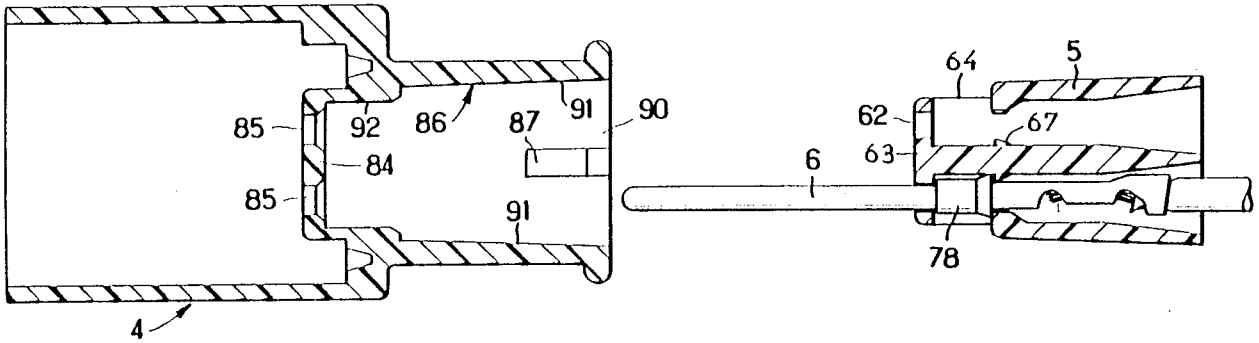
FIG. 6 is a longitudinal cross-sectional view of both male contact housing members.
Figure 7:
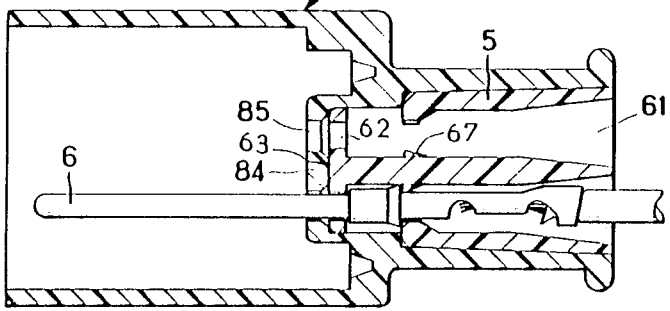
FIG. 7 is a cross-sectional view of the component member FIGS. 5 and 6 assembled.
Figure 8:
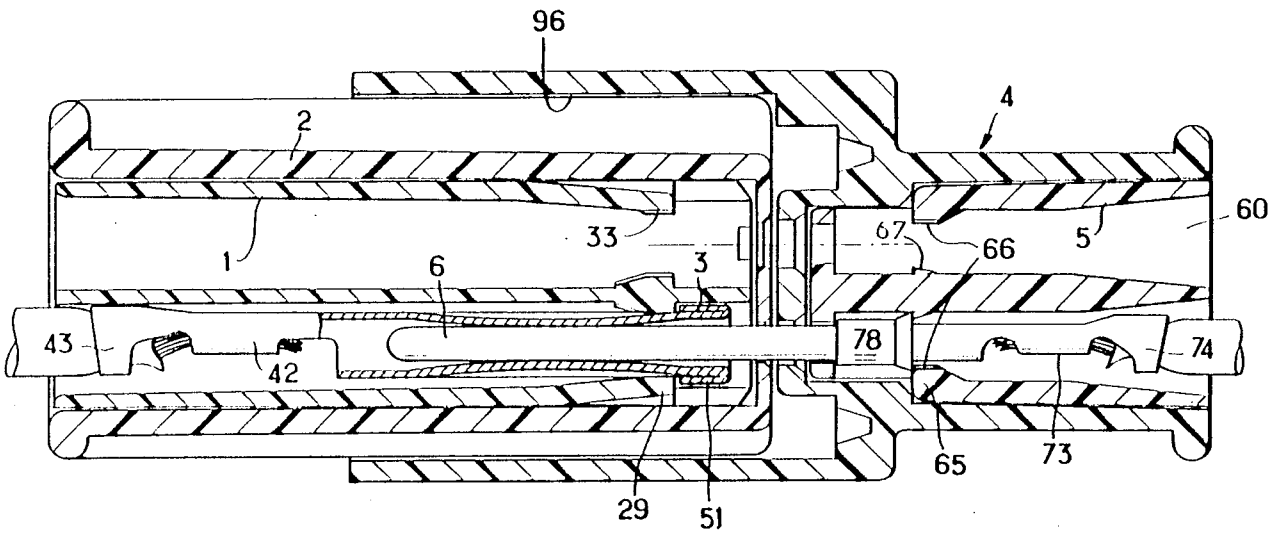
FIG. 8 is a cross-sectional view of the assembled connector members of FIGS. 4 and 7 as assembled.
Figure 9:
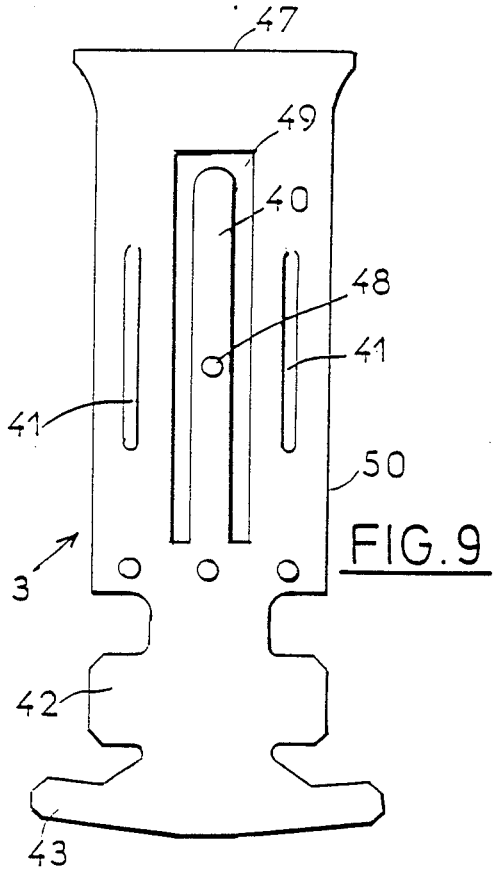
FIG. 9 is a plan view of the female contact member in its original flat state.
Figure 13:
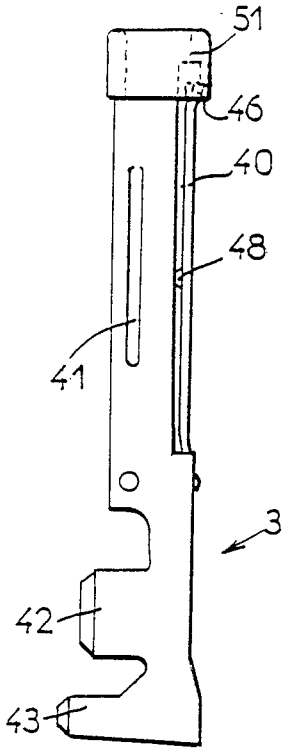
FIG. 13 is an elevational view of the finished female contact.

Housing member 4 (as illustrated in FIGS. 1, 6 and 7) includes an internal partition wall 84 which has holes 85. The ends of the male contacts 6 pass through the holes 85. A skirt 86, whose inside dimensions match the outside dimensions of the housing member 5, extends away from one side of the partition wall 84. The skirt 86 has, in two opposite sides 90, holes 87, which are positioned to correspond to lugs 68. The other two sides 91 have a slightly narrower region 92 adjacent the partition wall 84 and corresponding to the region of the housing member part 5 which has the openings 64. Sides 91 are flared outwardly towards the free end of skirt 86.

When housing member part 5 is inserted into skirt 86 of housing member 4, inclined walls 91 of the latter press lugs 65 against the male contacts 6 so that the contacts are locked into passages 60.

On the side opposite skirt 86 housing member 4 is extended by a skirt 95, the inside dimensions of which match the outside dimensions of part 2, so that it is able to accommodate the latter. Skirt 95 has a hole 97 in one wall 96. Hole 97 is designed to receive the latch member 20. Polarizing means are provided so that housing members 2 and 4 can only be assembled in one position.

The connector can easily be opened; all that is necessary is to press the button 22 to release the latch member 20 from the hole 97, so that parts 2 and 4 can be separated.

Blade 40 and stamped portions 41 project inside the conduit of the female contact 3 so that some force has to be exerted to insert male contact 5 thus ensuring a good electrical connection.

Of course, the invention is not limited to the embodiment described and shown. Numerous modifications of detail may be made thereto without departing from the scope of the invention.

There is claimed:

1. An electrical connector comprising:

a first insulative housing member, said first insulative housing member having at least one first parallel passage means, at least one cylindrical female contact member, one of said at least one cylindrical female contact member being positioned in each said at least one first parallel passage means, each said at least one first parallel passage means having an opening at one end for retaining said female contact member, each said at least one cylindrical female contact member having attachment means at a first end for attachment to an electrical conductor and collar means proximate a second end, said second end being opposite said first end, and a second insulative housing member, said second insulative housing member having at least one second parallel passage means, at least one male contact member, one of said at least one male contact member being positioned in each of said at least one second parallel passage means, each said at least one second parallel passage means having an opening for insertion of said male contact member, and retaining means for retaining said male contact member, attachment means at a first end of each male contact member for attachment of an electrical conductor, said male contact member having a cylindrical member at a second end, said first end of said male contact member being opposite said second end of said male contact member, said second end of said male contact member being adapted to be inserted into said at least one female contact member, and collet means intermediate said first end and said second end of each male contact member, one of said first insulative housing member or said second insulative housing member having skirt means, said skirt means being adapted to receive the other of said first or second insulative housing member, and latching means for holding said first and second insulative housing members together, each of said first insulative housing member and said second insulative housing member having a first part member and a second part member, and locking means for locking together said first part member and said second part member, said first part member of said first insulative housing member having said at least one first parallel passage means, an abutment member adapted to retain said second end of said female contact member, said abutment member being at the end of each said at least one first parallel passage means which is opposite to the end at which said opening is located, and first resilient tang means, said first resilient tang means having at least one projection, said at least one projection being adapted to cooperate with said collar means, said second part member of said first insulative housing member having body means, said body means being adapted to receive said first part member of said first insulative housing member, said body means having a back wall, and said back wall having holes, said holes being adapted to be aligned with said at least one first parallel passage means, said first part member of said second insulative housing member having said at least one second parallel passage means, said at least one second parallel passage means having a hole at one end, said hole being adapted to have said cylindrical member pass through and cooperate with one end of said collet means, second resilient tang means in said at least one second parallel passage means, each said second resilient tang means having a projection adapted to cooperate with the other end of said collet means, and said second part member of said second insulative housing member having a skirt means, said skirt means being adapted to receive said first part member of said second insulative housing member.

2. Electrical connector according to claim 1, wherein each of said at least one first parallel passage means has an interior wall and a projection on said interior wall, said projection having a ramp and an abrupt end, said ramp facing towards said opening.

3. Electrical connector according to claim 2, wherein each said first resilient tang means on said first part member of said first insulative housing member comprises a projection, a ramp on said projection facing towards each opening and an abrupt end on said ramp coplanar with said abrupt end on said projection on said interior wall of each of said at least one first parallel passage means, which has a longitudinal axis perpendicular to a plane common to both said abrupt ends.

4. Electrical connector according to claim 3, wherein each of said resilient tang means on said first part member of said first insulative housing member comprises on the side opposite said projection a rib the height of which is such that when said first part member and second part member of said first insulative housing member are assembled together said first resilient tang means is urged towards said cylindrical female contact member.

5. Electrical connector to claim 1, wherein said first part member of said first insulative housing member further includes two locking lugs on opposite sides, and said second part member of said first insulative housing member further includes corresponding holes adapted to receive said lugs by virtue of elastic deformation.

6. Electrical connector according to claim 1, wherein said at least one female contact member is electrically conductive, has crimped tabs at one end and a tubular conduit means, said tubular conduit means having a rolled elongate rectangular part and said collar means at a free end, said free end being outwardly folded at a fold line to form said collar means.

7. Electrical connector according to claim 6, wherein said elongate rectangular part has apertures, said apertures being in line with said collar means fold line.

8. Electrical connector according to claim 6, wherein said elongate rectangular part has a stamped longitudinal blade, said blade having a curved free end adapted to bear against an inside surface of said collar means.

9. Electrical connector according to claim 8, wherein said blade has at least one boss.

10. Electrical connector according to claim 8, wherein said rectangular part has at least one longitudinal upstanding portion.

11. Electrical connector according to claim 1, wherein said projection on said second resilient tang means is located on a free end thereof, and comprises a ramp facing towards said opening in said at least one second parallel passage means and an abrupt end to said ramp.

12. Electrical connector according to claim 1, wherein said skirt of said second part member of said second insulative housing member has at least one inclined surface whereby, when said first part member of second insulative housing member is inserted into said second part member of said second insulated housing member, said second resilient tang means are urged towards said at least one male contact member.

13. Electrical connector according to claim 1, wherein said at least one male contact member comprises metal having crimping lugs at one end, said collet means being proximate the other end, between said crimping lugs and said cylindrical member.

14. Electrical connector according to claim 1, wherein said first part member of said second insulative housing member has at least two locking lugs on opposite sides and said second part member of said second insulative housing member has corresponding holes, said holes being adapted to receive said lugs by elastic deformation.

15. A female electrical connector comprising:

a first insulative housing member, said first insulative housing member, having a first part member, a second part member and locking means for locking together said first part member and said second part member, said first part member of said first insulative housing member having at least one first parallel passage means, a cylindrical female contact member positioned in each said at least one first parallel passage means, each of said at least one first parallel passage means having an opening at one end for retaining said cylindrical female contact member, each female contact member having attachment means at a first end for attachment to an electrical conductor and collar means proximate a second end, said second end being opposite said first end, abutment means, said abutment means being at the end of each said at least one first parallel passage means which is opposite to the end at which said opening is located and being adapted to retain said second end of said female contact member, resilient tang means, said resilient tang means having at least one projection, said at least one projection being adapted to cooperate with said collar means, said second part member of said first insulative housing member having body means, said body means being adapted to receive said first part member of said first insulative housing member, said body means having a back wall, and said back wall having holes, said holes being adapted to be aligned with said at least one first parallel passage means.

16. The female electrical connector according to claim 15, further comprising skirt means, said skirt being adapted to receive a male insulative housing member.

17. The female electrical connector according to claim 15, wherein each said at least one first parallel passage means has an interior wall and a projection on said interior wall, said projection having a ramp and an abrupt end, said ramp facing towards said opening.

18. The female electrical connector according to claim 17, wherein each said resilient tang means on said first part member of said first insulative housing member comprises a projection, a ramp on said projection facing towards each opening and an abrupt end on said ramp coplanar with said abrupt end on said projection on said interior wall of each said at least one first parallel passage means, which has a longitudinal axis perpendicular to a plane common to both said abrupt ends.

19. The female electrical connector according to claim 18, wherein each of said resilient tang means on said first part member of said first insulative housing member comprises on the side opposite said projection a rib the height of which is such that when said first part member and second part member of said first insulative housing member are assembled together said resilient tang means is urged towards said cylindrical female contact member.

20. The female electrical connector according to claim 15, wherein said first part member of said first insulative housing member further includes two locking lugs on opposite sides, and said second part member of said first insulative housing member further includes corresponding holes adapted to receive said lugs by virtue of elastic deformation.

21. The female electrical connector according to claim 15, wherein said at least one female contact member is electrically conductive, has crimped tabs at one end and a tubular conduit means, said tubular conduit means having a rolled elongate rectangular part and said collar means at a free end, said free end being outwardly folded at a fold line to form said collar means.

22. The female electrical connector according to claim 21, wherein said elongate rectangular part has apertures, said apertures being in line with said collar means fold line.

23. The female electrical connector according to claim 21, wherein said elongate rectangular part has a stamped longitudinal blade, said blade having a curved free end adapted to bear against an inside surface of said collar means.

24. The female electrical connector according to claim 23, wherein said blade has at least one boss.

25. A female electrical connector according to claim 23, wherein said rectangular part has at least one longitudinal upstanding portion.

26. A male electrical connector comprising:

an insulative housing member having a first part member and a second part member, said insulative housing member having at least one parallel passage means, a male contact member in each said at least one parallel passage means, each said at least one second parallel passage means having an opening for insertion of said male contact member, and retaining means for retaining said male contact member, means at a first end of said male contact member for attachment of an electrical conductor, a cylindrical member at a second end of said male contact member, said first end of said male contact member being opposite said second end, and said second end being adapted to be inserted into a female contact member, said male contact member having a collet means, said collet means being intermediate said first end and said second end, latching means for holding said first and second insulative housing members together, locking means, said locking means being adapted for locking together said first part member and said second part member, said first part member of said insulative housing member having said at least one parallel passage means, said at least one parallel passage means having a hole at one end, said hole being adapted to have said cylindrical member pass through and cooperate with one end of said collet means, resilient tang means in said at least one parallel passage means, said resilient tang means including a projection adapted to cooperate with the other end of said collet means, and said second part member of said insulative housing member having a skirt means, said skirt means being adapted to receive said first part member of said insulative housing member.

27. The male electrical connector of claim 26, wherein said insulative housing member includes skirt means, said skirt means being adapted to receive a female insulative housing member.

28. Electrical connector according to claim 26, wherein said projection on said second resilient tang means is located on a free end thereof, and comprises a ramp facing towards said opening in said at least one second parallel passage means and an abrupt end to said ramp.

29. A male electrical connector according to claim 27 wherein said skirt of said second part member of said insulative housing member has at least one inclined surface whereby, when said first part member of insulative housing member is inserted into said second part member of said insulated housing member, said resilient tang means are urged towards said male contact member.

30. A male electrical connector according to claim 29, wherein said male contact member comprises metal having crimping lugs at one end, said collet means being proximate the other end, between said crimping lugs and said cylindrical member.

31. A male electrical connector according to claim 26, wherein said first part member of said insulative housing member has at least two locking lugs on opposite sides, and said second part member of said insulative housing member has corresponding holes, said holes being adapted to receive said lugs by elastic deformation.

* * * * *